US006488126B1

(12) United States Patent
Yamakawa et al.

(10) Patent No.: US 6,488,126 B1
(45) Date of Patent: Dec. 3, 2002

(54) ELEVATOR CONTROL DEVICE

(75) Inventors: Shigeki Yamakawa, Tokyo (JP); Satoshi Suzuki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/980,256

(22) PCT Filed: Apr. 24, 2000

(86) PCT No.: PCT/JP00/02667

§ 371 (c)(1),
(2), (4) Date: Nov. 29, 2001

(87) PCT Pub. No.: WO01/81224

PCT Pub. Date: Nov. 1, 2001

(51) Int. Cl.[7] ..... B66B 1/34
(52) U.S. Cl. ..... 187/391; 187/413
(58) Field of Search ..... 187/277, 391, 187/314, 333, 413, 414, 298, 250, 254, 313, 316, 325

(56) References Cited

U.S. PATENT DOCUMENTS 3,610,371 A * 10/1971 Abbott ..... 187/290
3,747,300 A * 7/1973 Knudson ..... 55/472
5,271,455 A * 12/1993 Semple ..... 165/80.4
5,679,934 A * 10/1997 Juntunen et al. ..... 187/384
6,321,877 B2 * 11/2001 Yamakawa ..... 187/277

FOREIGN PATENT DOCUMENTS

| | | |
|---|---|---|
| JP | 62-265798 | 11/1987 |
| JP | 3-18569 | 1/1991 |
| JP | 0326676 A * | 3/1991 |
| JP | 4-338074 | 11/1992 |
| JP | 4-365773 | 12/1992 |
| JP | 6-29194 | 4/1994 |
| JP | 2580507 | 6/1998 |

OTHER PUBLICATIONS

U.S. patent application Ser. No. 09/619,490, Ishikawa et al., filed Jul. 19, 2000.

* cited by examiner

*Primary Examiner*—Jonathan Salata
(74) *Attorney, Agent, or Firm*—Leydig, Voit & Mayer, Ltd.

(57) ABSTRACT

In an elevator apparatus, a radiation fin device on which heat generating parts are mounted and a cooling fan for cooling the radiation fin device by forced air are accommodated in a tall and narrow case. The cooling fan has a rotation shaft extending in a direction perpendicular to a fin attaching surface of the case. A ventilating passage is provided between the radiation fin device and the cooling fan by a ventilating duct.

3 Claims, 4 Drawing Sheets

ELEVATOR CONTROL DEVICE

TECHNICAL FIELD

The present invention relates to an elevator controlling apparatus for controlling the operation of an elevator.

BACKGROUND ART

FIG. 7 is a plan view showing a conventional elevator disclosed in, for example, Japanese Patent Application Laid-Open No. Hei 3-18569. In the figure, a car 1 is raised and lowered within a hoistway 2. A main control panel 3 and a sub-control panel 4 for controlling the operation of the elevator are located at the bottom portion, i.e., a pit 2*a* of the hoistway 2. The main control panel 3 is supported by a supporting stand 7 at the inside of a hall 5 side inspection door 6. The sub-control panel 4 is supported by supporting legs 8 in the space behind the car 1.

In recent years, cases where the controlling apparatus, i.e., the main control panel 3 and the sub-control panel 4 in this example, is disposed in the space in the hoistway 2, as shown in this example, without providing a machine room at the upper portion of the hoistway 2 have increased.

Next, FIG. 8 is a cross-sectional view of a conventional elevator controlling apparatus disclosed in, for example, Japanese Patent Application Laid-Open No. Hei 4-338074. In the figure, a case 11 is provided with an air inlet 11*a* and a plurality of air outlets 11*b*. The air inlet 11*a* is disposed at the lower portion of the side of the case 11, and the air outlets 11*b* are disposed at the top of the case 11. A filter 12 is provided at the air inlet 11*a*.

Amounting panel 13 is fixed in the case 11. A printed circuit board 14 is attached to the mounting panel 13. A plurality of on-board parts 15 are mounted on the printed circuit board 14. Also, a radiation fin device 16 is fixed in the case 11. The radiation fin device 16 is provided with a plurality of fin portions 16*a*.

A plurality of heat generating parts 17 are mounted on the radiation fin device 16. Snubbers 18 which are composed of resistors, capacitors or the like are attached to the heat generating parts 17. These snubbers 18 restrain surge voltages generated when switching high power semiconductor devices.

A first cooling air passage 19*a* is formed between the neighboring fin portions 16*a* in the case 11. A second cooling air passage 19*b* is formed between the printed circuit board 14 and the radiation fin device 16 in the case 11. A cooling fan 20 is disposed between the first and second cooling air passages 19*a* and 19*b* and the air inlet 11*a*.

In such a controlling apparatus, cooling air is introduced into the case 11 from the air inlet 11*a* by driving the cooling fan 20. The air flowing into the case 11 passes along the paths as shown by the arrows A and B in FIG. 8, and is exhausted outside of the case 11 through the air outlets 11*b*. Accordingly, the on-board parts 15 and the heat generating parts 17 are cooled directly or through the radiation fin device 16.

As described above, in recent elevators, since the controlling apparatus is disposed in a narrow space, a reduction in the thickness of the controlling apparatus is desired. In contrast, in the conventional controlling apparatus of the type shown in FIG. 8, the axis of the cooling fan 20 is disposed vertically to send the cooling air from the lower part to the upper part. Accordingly, the depth (thickness) of the case 11 can not be reduced to less than the diameter of the cooling fan 20, so that reduction of the whole controlling apparatus the thickness is disturbed by the cooling fan 20.

DISCLOSURE OF THE INVENTION

In order to solve the above-noted defects, an object of the present invention is to provide an elevator controlling apparatus which can be reduced in a total size of thickness and disposed in a narrow space.

According to the present invention, there is provided an elevator controlling apparatus comprising: a case including a fin attaching surface, an air inlet and an air outlet, the air outlet being provided in the fin attaching surface above the air inlet; a radiation fin device attached to the fin attaching surface in the case; a heat generating part mounted on the radiation fin device; a cooling fan for cooling the radiation fin device, disposed in the case and having a rotation shaft which extends in a direction perpendicular to the fin attaching surface; and a ventilating duct disposed in the case for forming a ventilating passage between the radiation fin device and the cooling fan.

BEST MODE FOR CARRYING OUT THE INVENTION

A preferred embodiment of the present invention will now be described with reference to the accompanying drawings.

First Embodiment

Figure 1:
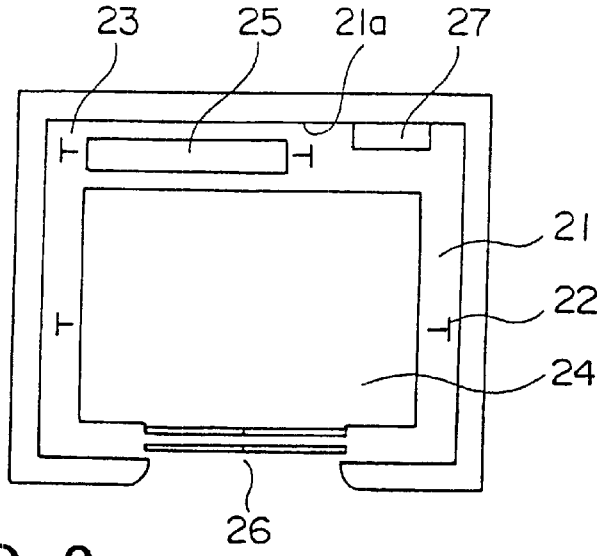
FIG. 1 is a plan view showing an elevator according to a first embodiment of this invention.

FIG. 1 is a plan view showing an elevator according to a first embodiment of this invention. In the figure, a pair of car guide rails 22 and a pair of counterweight guide rails 23 are provided in a hoistway 21. A car 24 is guided by the car guide rails 22 to be raised and lowered within the hoistway 21. A counterweight 25 is guided by the counterweight guide rails 23 to be raised and lowered within the hoistway 21. A controlling apparatus 27 for controlling the operation of the elevator is provided on a wall surface 21*a* of the hoistway 21 opposite a hall 26.

Figure 2:
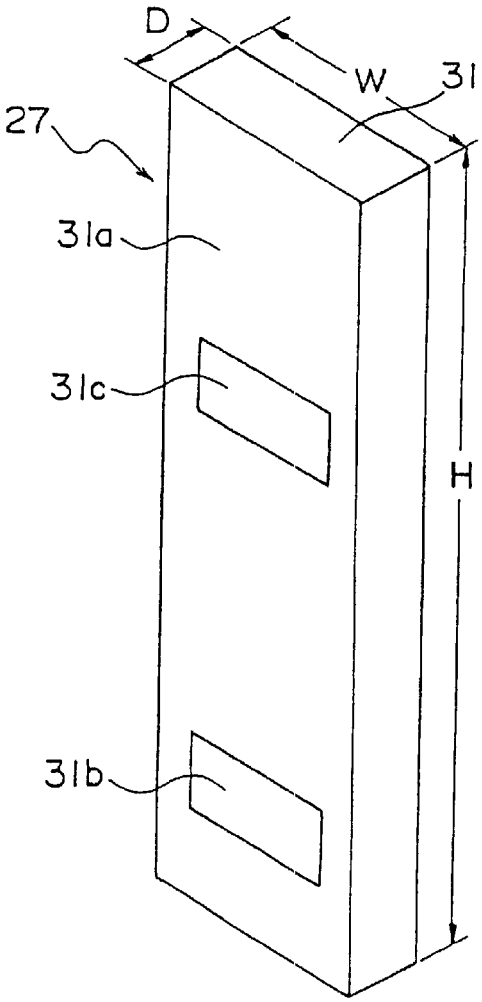
FIG. 2 is a perspective view showing the controlling apparatus in FIG. 1.
Figure 3:
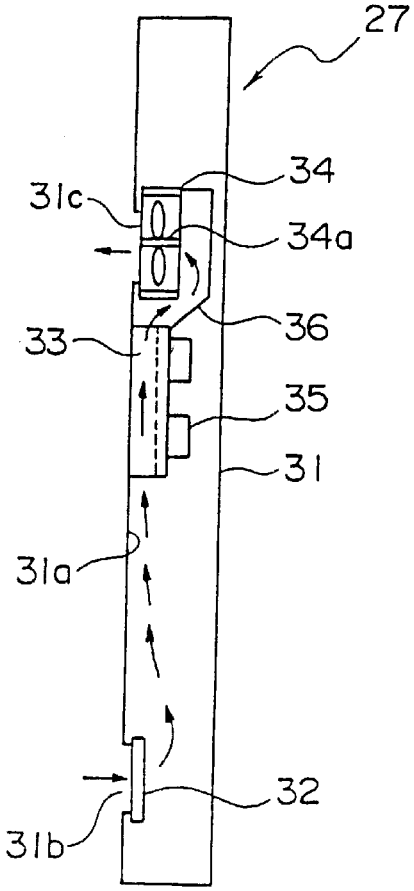
FIG. 3 is a vertical sectional view of the controlling apparatus in FIG. 2.
Figure 4:
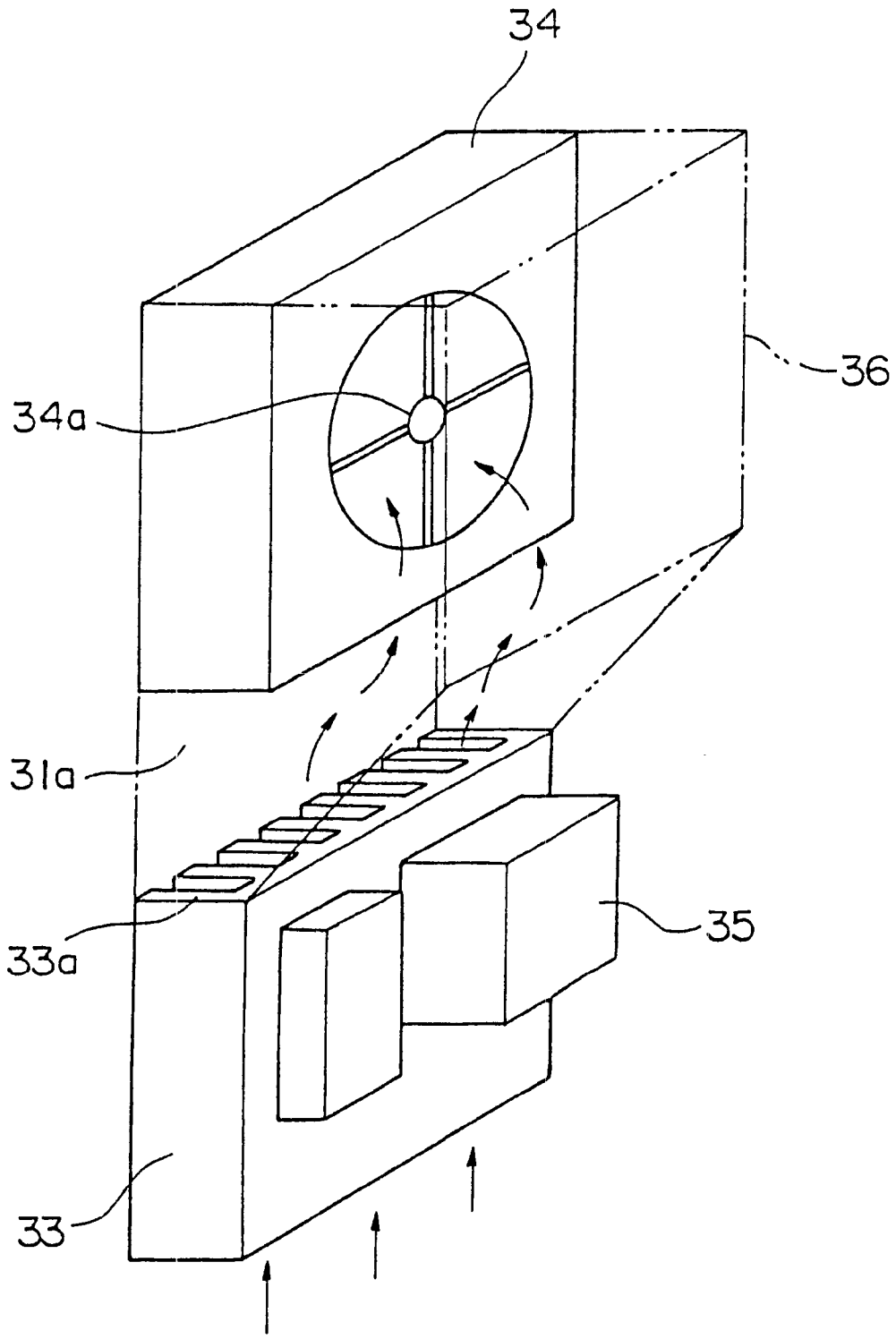
FIG. 4 is an expanded perspective view showing an essential portion of FIG. 3.

FIG. 2 is a perspective view showing the controlling apparatus 27 in FIG. 1, FIG. 3 is a vertical sectional view of the controlling apparatus 27 in FIG. 2, and FIG. 4 is an expanded perspective view showing an essential portion of FIG. 3. In the figures, a case 31 is a tall and thin shaped rectangular parallelepiped having a height dimension H larger than a width dimension W and a depth dimension D smaller than the width dimension W. The case 31 is provided with a vertical fin attaching surface 31*a*, and an air inlet 31*b* and an air outlet 31*c* are provided in the fin attaching surface 31*a*. The air outlet 31*c* is disposed above the air inlet 31*b*. A filter 32 is provided at the air inlet 31*b*.

A radiation fin device 33 which has a plurality of parallel fin portions 33*a*, and a cooling fan 34 for cooling the radiation fin device 33 by forced air are provided in the case 31. The radiation fin device 33 is fixed to the inside of the fin attaching surface 31*a* below the air outlet 31*c*. The cooling fan 34 is attached to face the air outlet 31*c* so that its rotation shaft 34*a* extends in a direction perpendicular to the fin attaching surface 31*a*.

A plurality of heat generating parts 35 are mounted on a surface opposing the fin portions 33*a* of the radiation fin device 33. A ventilating duct 36 for forming a ventilating passage is disposed between the radiation fin device 33 and the cooling fan 34.

Next, the operation will be described. When the cooling fan 34 is driven, air flows in the case 31 through the passage as shown by the arrows in FIG. 3. Accordingly, the radiation fin device 33 is cooled by the forced air and the heat of the heat generating parts 35 is radiated through the radiation fin device 33.

In such a controlling apparatus 27, since the cooling fan 34 is attached so that the rotation shaft 34*a* extends horizontally in relation to the vertical fin attaching surface 31*a*, the size of the diameter of the cooling fan 34 only affects the width dimension of the case 31 and has no effect on the depth (thickness) dimension. Accordingly, the depth of the case 31 can be reduced while the cooling capacity is secured by using a cooling fan 34 which has sufficient diameter. Therefore, the thickness of the whole controlling apparatus 27 can be reduced and it can be disposed in a narrow space.

Second Embodiment

Figure 5:
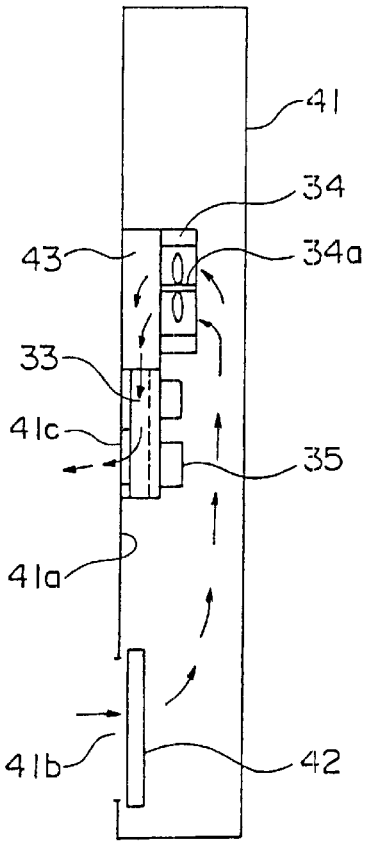
FIG. 5 is a vertical sectional view of an elevator controlling apparatus according to a second embodiment of this invention.
Figure 6:
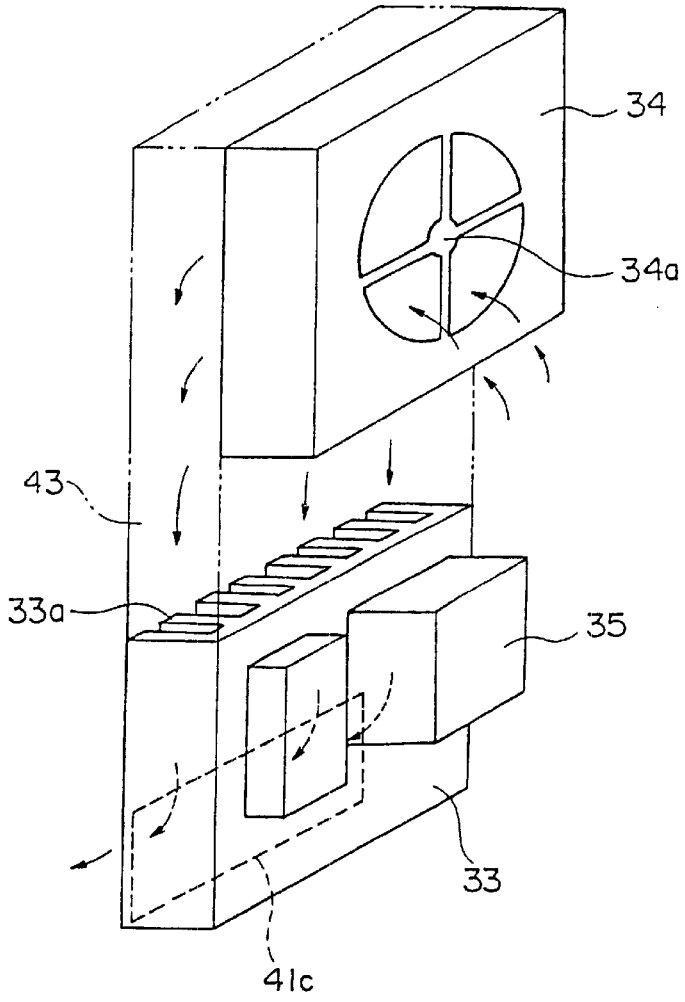
FIG. 6 is an expanded perspective view showing an essential portion of FIG. 5.
Figure 7:
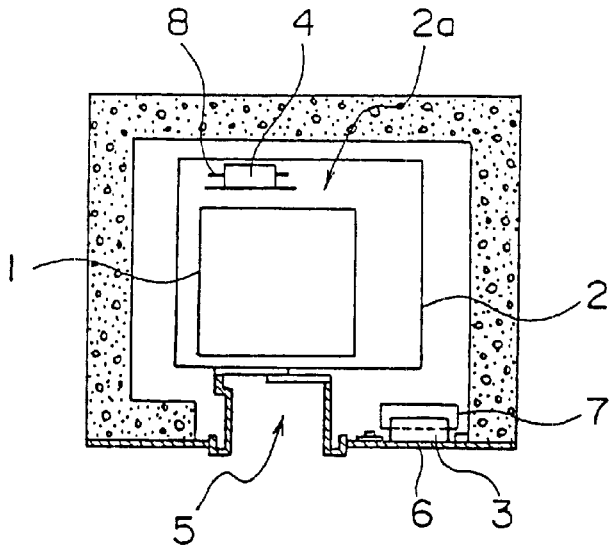
FIG. 7 is a plan view showing an example of a conventional elevator.
Figure 8:
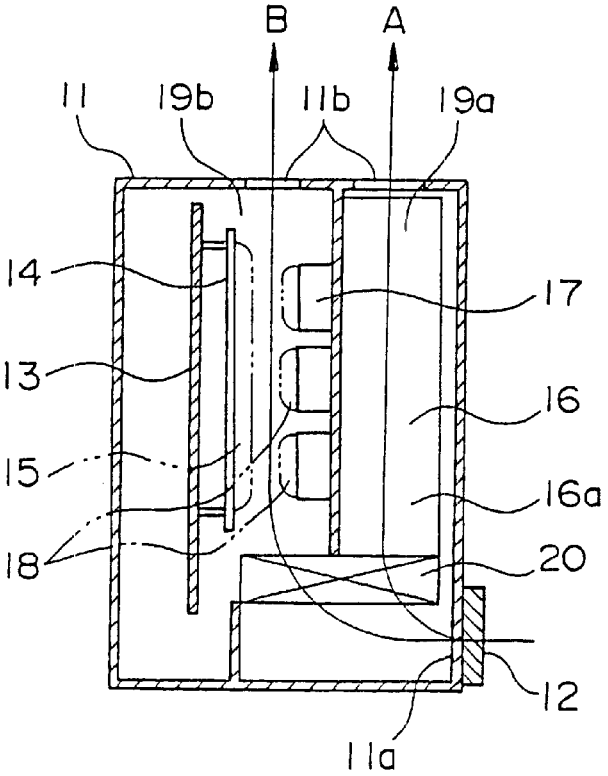
FIG. 8 is a cross-sectional view of a conventional elevator controlling apparatus.

Next, FIG. 5 is a vertical sectional view of an elevator controlling apparatus according to a second embodiment of this invention, and FIG. 6 is an expanded perspective view showing an essential portion of FIG. 5. In the figures, a tall and thin shaped case 41 is provided with a vertical fin attaching surface 41*a*, and an air inlet 41*b* and an air outlet 41*c* are provided in the fin attaching surface 41*a*. The air outlet 41*c* is disposed above the air inlet 41*b*. A filter 42 is provided at the air inlet 41*b*.

The radiation fin device 33 which has a plurality of parallel fin portions 33*a*, and the cooling fan 34 for cooling the radiation fin device 33 by forced air are provided in the case 41. The radiation fin device 33 is attached to face the air outlet 41*c*. The cooling fan 34 is disposed above the radiation fin device 33 so that its rotation shaft 34*a* extends in a direction perpendicular to the fin attaching surface 41*a*.

A plurality of heat generating parts 35 are mounted on the surface opposing the fin portions 33*a* of the radiation fin device 33. A ventilating duct 43 for forming a ventilating passage is disposed between the radiation fin device 33 and the cooling fan 34.

Next, the operation will be described. When the cooling fan 34 is driven, air flows in the case 31 through the passage as shown by the arrows in FIG. 5. Accordingly, the radiation fin device 33 is cooled by the forced air and the heat of the heat generating parts 35 is radiated through the radiation fin device 33.

In such a controlling apparatus 27, since the cooling fan 34 is attached so that the rotation shaft 34*a* extends horizontally in relation to the vertical fin attaching surface 41*a*, the depth of the case 41 can be reduced while the cooling capacity is secured by using a cooling fan 34 which has sufficient diameter. Therefore, the thickness of the whole controlling apparatus can be reduced and it can be disposed in a narrow space.

Further, in comparison with the first embodiment, the configuration of the ventilating duct 43 can be simplified.

What is claimed is:

1. An elevator controlling apparatus comprising:

a case including a fin attaching surface, an air inlet, and an air outlet, said air outlet being in said fin attaching surface, spaced from said air inlet;

a radiation fin device attached to said fin attaching surface of said case;

a heat generating part mounted on said radiation fin device;

a cooling fan for cooling said radiation fin device, disposed in said case, and having a rotation shaft which extends in a direction perpendicular to said fin attaching surface; and a ventilating duct disposed in said case forming a ventilating passage between said radiation fin device and said cooling fan.

2. The elevator controlling apparatus according to claim 1, wherein said cooling fan faces said air outlet and said radiation fin device is spaced from said cooling fan.

3. The elevator controlling apparatus according to claim 1, wherein said radiation fin device faces said air outlet and said cooling fan is attached to said ventilating duct and spaced from said radiation fin device.

* * * * *